US006889947B2

(12) United States Patent
Alberts

(10) Patent No.: US 6,889,947 B2
(45) Date of Patent: May 10, 2005

(54) HOLDER

(76) Inventor: Frederick William Alberts, 49 Mayfair St., Mt. Claremont WA 6010 (AU)

( * ) Notice: Subject to any disclaimer, the term of this patent is extended or adjusted under 35 U.S.C. 154(b) by 0 days.

(21) Appl. No.: 10/257,518

(22) PCT Filed: Apr. 3, 2001

(86) PCT No.: PCT/AU01/00369

§ 371 (c)(1),
(2), (4) Date: Oct. 3, 2002

(87) PCT Pub. No.: WO01/74451

PCT Pub. Date: Oct. 11, 2001

(65) Prior Publication Data

US 2003/0106977 A1 Jun. 12, 2003

(30) Foreign Application Priority Data

Apr. 3, 2000 (AU) ..... PQ6654
Dec. 19, 2000 (AU) ..... PR2166

(51) Int. Cl.[7] ..... A47F 5/00

(52) U.S. Cl. ..... 248/289.11; 248/289.31; 248/230.1

(58) Field of Search ..... 248/311.2, 313, 248/206.1, 231.51, 309.1, 309.2, 315, 316.5, 229.13, 229.23, 515, 521, 522, 523, 289.11, 289.31

(56) References Cited

U.S. PATENT DOCUMENTS 2,876,027 A * 3/1959 Sulmonetti ..... 403/53
3,547,391 A * 12/1970 Johnson ..... 248/311.3
3,603,550 A * 9/1971 Byrd ..... 248/313
3,780,972 A * 12/1973 Brodersen ..... 248/313
4,586,687 A * 5/1986 Ziaylek, Jr. ..... 248/313
5,354,029 A * 10/1994 Ziaylek et al. ..... 248/313
5,984,248 A * 11/1999 Evans et al. ..... 248/214
6,059,245 A * 5/2000 Hermansen et al. ..... 248/311.2
6,568,644 B2 * 5/2003 Pedersen ..... 248/229.13

FOREIGN PATENT DOCUMENTS

| | | |
|---|---|---|
| DE | 20003957 U1 | 12/1999 |
| EP | 384 654 A | 8/1989 |
| JP | 134759 | 6/1994 |
| SU | 1819640 A1 | 3/1991 |
| WO | WO 91/10027 | 7/1991 |

* cited by examiner

*Primary Examiner*—Leslie A. Braun
*Assistant Examiner*—Tan Le
(74) *Attorney, Agent, or Firm*—Needle & Rosenberg, P.C.

(57) ABSTRACT

Article holder (10) comprises seat member (12) shaped to receive article, gate member (20) hingedly coupled to seat member (12), gate member (20) shaped to cooperate with seat member (12) in closed position so as to grasp article, rotatable handle (22) connected with gate member (20) so as to move gate member (20) between open position and closed position as handle (22) is rotated. Handle (22) has locking means (34, 36, 37, 38) for locking handle (22) when handle (22) is rotated to lock position, wherein handle (22) must be over rotated further than position where gate member (20) is closed to be positioned in lock position. Over rotation causes compressive gripping force to gate member (20) such that gate member (20) continues to grasp article while handle (22) is in lock position.

13 Claims, 6 Drawing Sheets

HOLDER

The present application is a 35 U.S.C. §371 national phase application from, and claims priority to, international application PCT/AU01/00369, filed Apr. 3, 2001 (published under PCT Article 21(2) in English), which claims priority to Australian patent application Serial No. PQ6654, filed Apr. 3, 2000, and Australian patent application Serial No. PR2166, filed Dec. 19, 2000, which applications are incorporated herein in their entirety by this reference.

FIELD OF THE INVENTION

The present invention relates to a holder for holding a predetermined article. In particular, although not exclusively, the present invention relates to a holder for holding a fire extinguisher.

BACKGROUND OF THE INVENTION

In some jurisdictions it is compulsory for a vehicle, and in particular trucks and road trains to carry fire extinguishers. Currently, a fire extinguisher is held in position by a bracket having a latch that wraps around the extinguisher and holds it in place. Road trains often travel across bumpy ground, particularly in outback Australia. Under these conditions the bracket holding the extinguisher is subject to intense vibration. This results in the existing brackets rapidly falling apart.

There is therefore a need for a holder that is sturdy enough to withstand vibration.

SUMMARY OF THE INVENTION

According to the present invention there is provided a holder for holding a predetermined article, said holder including:

a seat member shaped to receive the article;

a gate member hingedly coupled to the seat member, the gate member shaped to co-operate with the seat member in a closed position so as to grasp the article; and a rotatable handle connected with the gate member so as to move the gate member between an open position and the closed position as the handle is rotated, the handle having a locking means for locking the handle when the handle is rotated to a lock position, wherein the handle must be rotated (over rotated) further than a position where the gate member is closed to be positioned in the lock position, the over rotation causing a compressive gripping force to the gate member such that the gate continues to grasp the article while the handle is in the lock position.

Preferably, locking the handle in the back position when an article is being held by the holder retains a torsoinal force along a hinge portion of the handle.

Preferably, the handle forms a part of a hinged coupling between the gate member and the seat member.

Preferably, when the gate member is in the lock position, the co-operatively shaped seat and gate members together are slightly smaller than the article so that the members apply a compressive gripping force to the article as it is grasped.

Preferably, the gate member is provided with a resiliently compressible lining. Preferably, the seat member is also provided with a resiliently compressible lining.

Preferably, the seat member is provided with a projection for preventing the article from moving through a gap between the seat and gate members in a first direction. More preferably, the article rests on the projection.

BRIEF DESCRIPTION OF THE INVENTION

In order to provide a better understanding, preferred embodiments of the present invention will now be described in detail, by way of example only, with reference to the accompanying drawings in which.

DETAILED DESCRIPTION OF THE INVENTION

Figure 1:
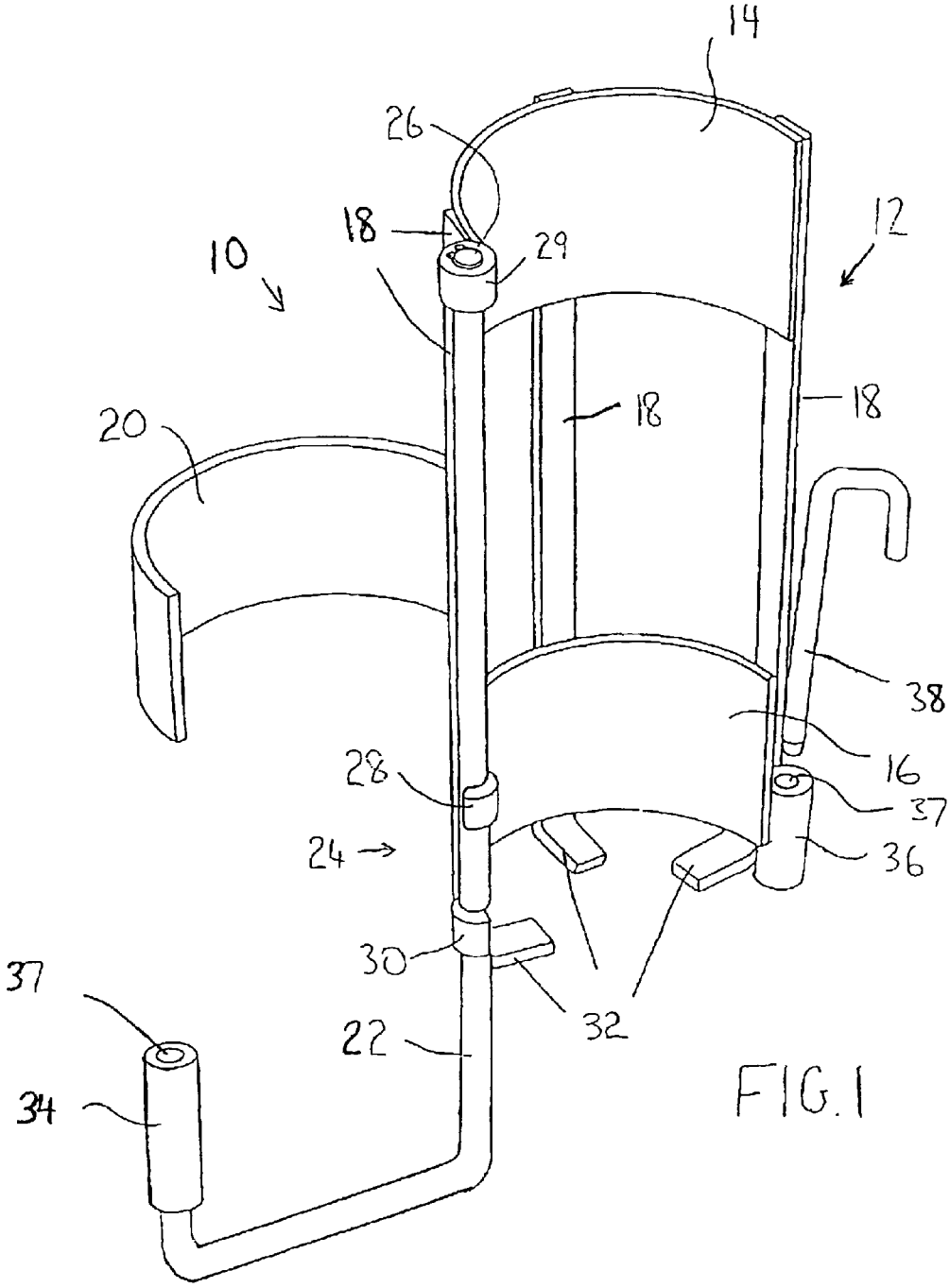
FIG. 1 is a perspective view of a first embodiment of the holder in an open configuration.
Figure 2:
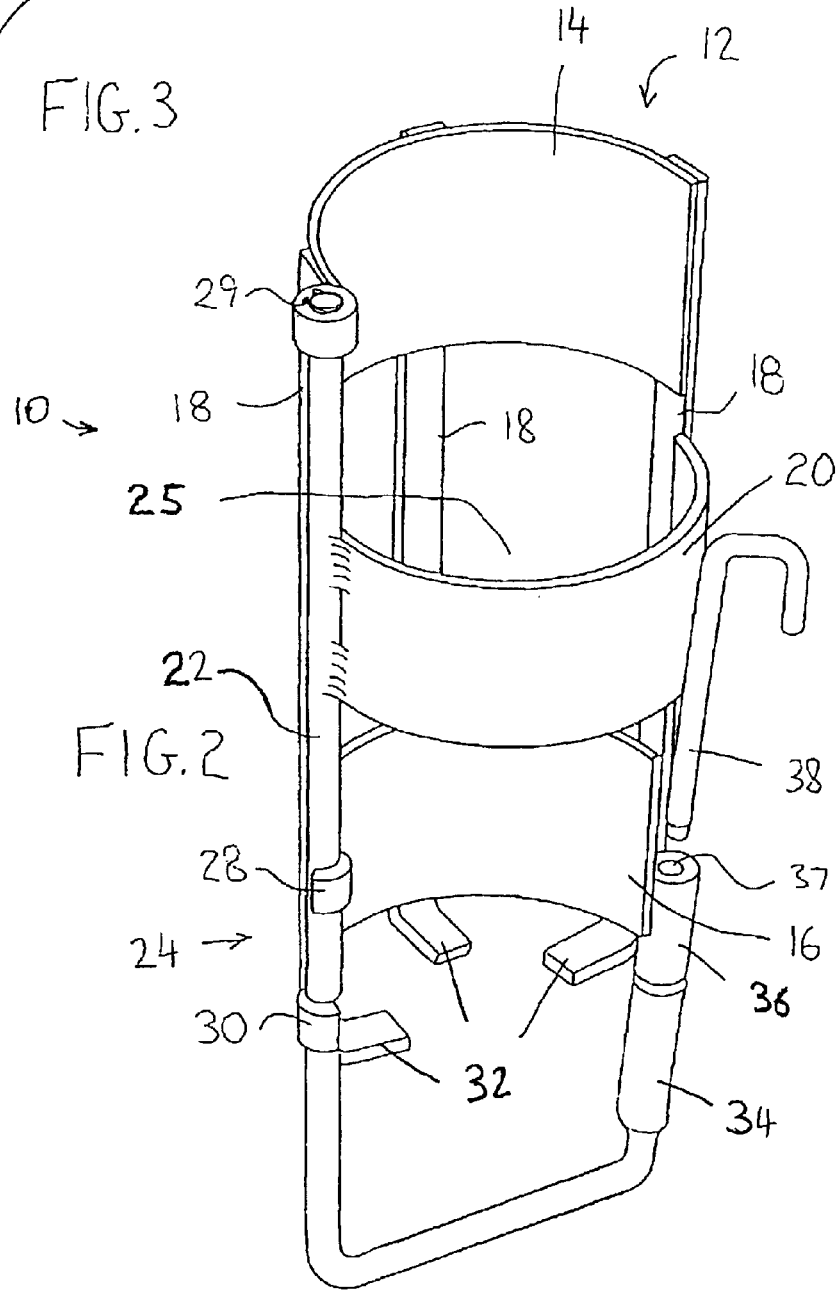
FIG. 2 is a perspective view of the holder of FIG. 1 in a closed configuration.

Referring to FIGS. 1 and 2, there is shown a holder 10 which includes a seat member 12 hingedly coupled to a gate member 20. The seat member 12 includes an upper panel 14 and a lower panel 16 curved to receive a cylindrical article such as a fire extinguisher. The panels 14 and 16 are spaced apart by connecting members 18. One side of the gate member 20 is connected to an elongate member 22. The elongate member 22 is J-shaped with the long back of the J being connected to the gate member 20, which in turn is rotatably coupled to the seat member 12 by hinge collars 28, 29 and 30. A part of the long back of the elongate member has a two-fold function. First, it forms a hinge pin, which in cooperation with hinge collars 28, 29 and 30 act as a hinge between the gate member 20 and the seat member 12. Second, it is a torsion bar for transferring a torsional force to the gate member.

The lower panel 16 includes lugs 32 for supporting the fire extinguisher in a manner that allows the fire extinguisher to be either upright or upside down. The shorter upwardly directed portion of the foot of the J-shaped elongate member 22 forms a handle for rotating the elongate member about a longitudinal axis of rotation of the hinge pin. The handle is spaced from the hinge pin and can therefore gain leverage to assist in rotating the hinge pin. The handle has a sleeve 34 that aligns with a sleeve 36 when the handle is rotated to a locked position. Rotation of the handle moves the gate member 20 from an open position to a closed position. The closed position is where the gate member makes contact with the fire extinguisher. The handle may be rotated further than the closed position, with force, to the locked position. As the handle is moved from the closed position to the locked position, it is resisted by contact of the gate member with the fire extinguisher. However leverage can be used to apply a torsional force through the torsion bar for transferring the torsional force to the gate member 20. In the locked position the sleeves 34 and 36 align and a locking pin 38 may be inserted through a hole 37 in sleeve 36 and protrude into another hole 37 in sleeve 34 thus locking the gate member 20 in the locked position.

Together the seat member 12 and gate member 20 are prehensible, that is when the handle rotated so as to close the gate member 20, members 12 and 20 are able to grasp the fire extinguisher. A space between the members 12 and 20 is indicated by 25. The grasping of the article tightens as the torsion force is applied to the torsion bar as the handle is moved to the locked position.

When the seat and gate members 12 and 20 are in the locked position, without holding an extinguisher the space 25 is slightly smaller than the fire extinguisher. Particularly when padding lines members 12 and 20 as described below. The handle must be turned with force to reach the locked position. This creates a torsional force in the torsion bar which is applied to the gate member 20 which flexes a little and grips the fire extinguisher so that it will not fall out of the holder. The torsional force along with the flexing of the gate member 20 keeps the locked handle under tension.

Figure 3:
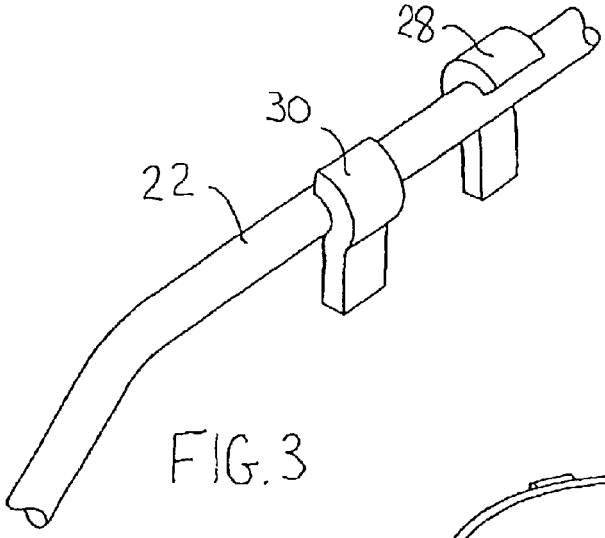
FIG. 3 is a close up view of the pivotal connection of a hinge pin to a first member.

Referring to FIG. 3, the elongate member 22 may be detached from seat member 12 by removing a fastener, in the form of a circlip 29, and drawing the hinge pin of the elongate member 22 downward so that it is free from the full lap collar 29. It is then released from half lap hinge 24 which includes upper and lower latch parts 28 and 30, by twisting the handle so as to release it from the latch parts 28 and 30.

Figure 4:
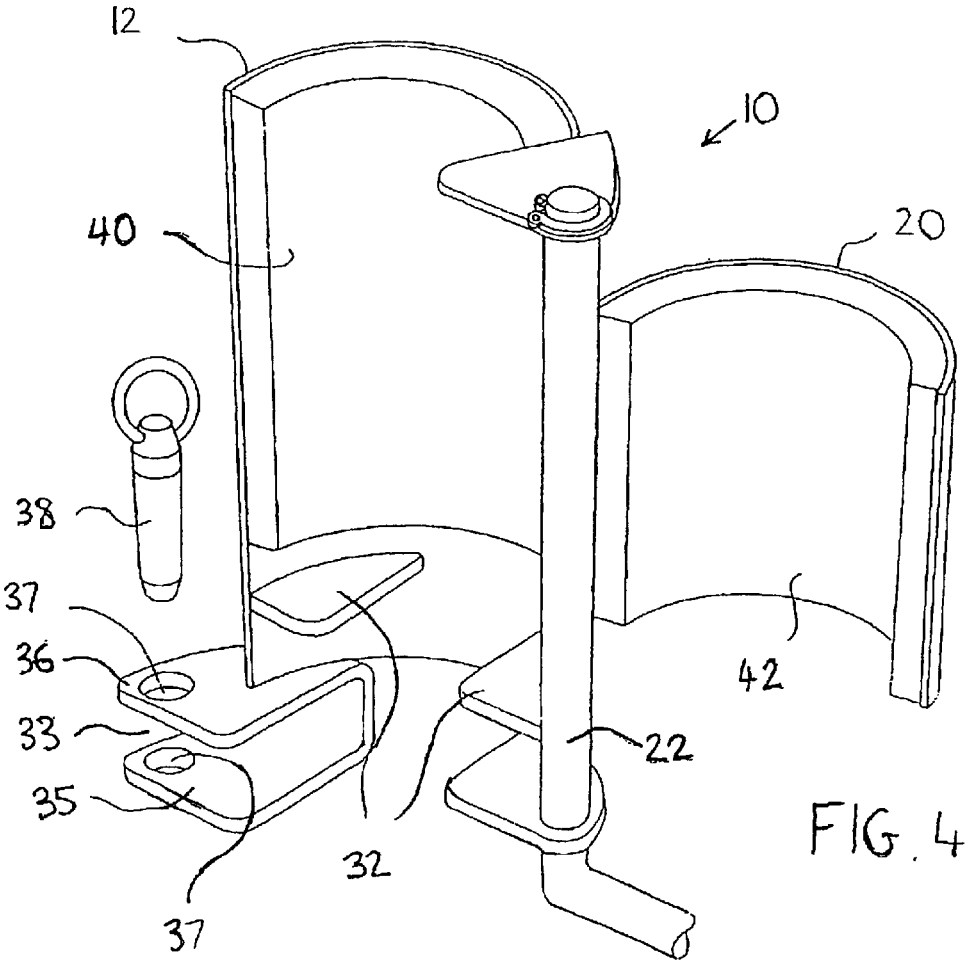
FIG. 4 is a perspective view of a second embodiment of the holder.

Referring to FIG. 4, there is shown an alternative embodiment of the holder 10, with like numbers denoting like parts. In this instance, the lugs 32 take a slightly different form. The locking pin 38 passes through a hole in horizontal plate 36 which is spaced from another plate 35. The handle is received within a space 33 between the plates 36 and 35. The locking pin is inserted through holes 37 in the plates 36 and 35. On the inside of the seat member 12 and gate member 20 is a resiliently compressible sponge 40 and 42 respectively. This provides dampening of vibrations and also provides a further bias which the rotating force on the handle must overcome in order to properly lock it in position. The bias creates a tighter grip on the extinguisher.

Figure 6:
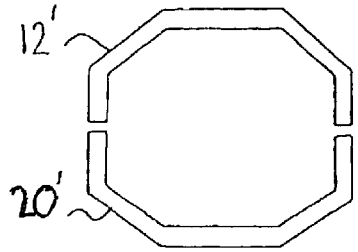
FIG. 6 is a schematic representation of an alternative shape of the first and second members of the holder of either FIG. 1 or FIG. 4.
Figure 5:
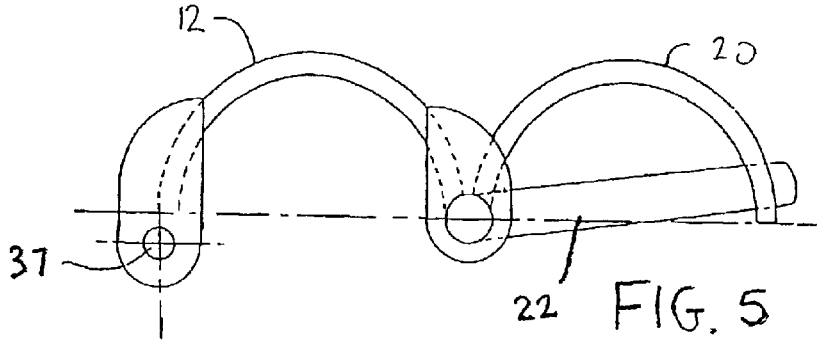
FIG. 5 is an upper view of the holder of FIG. 4.

As seen in FIG. 6, the members 12 and 20 need not be half cylindrical in shape and may be other shapes, such as half octagonal so that together members 12 and 20 form an octagon rather than a cylinder.

Figure 7:
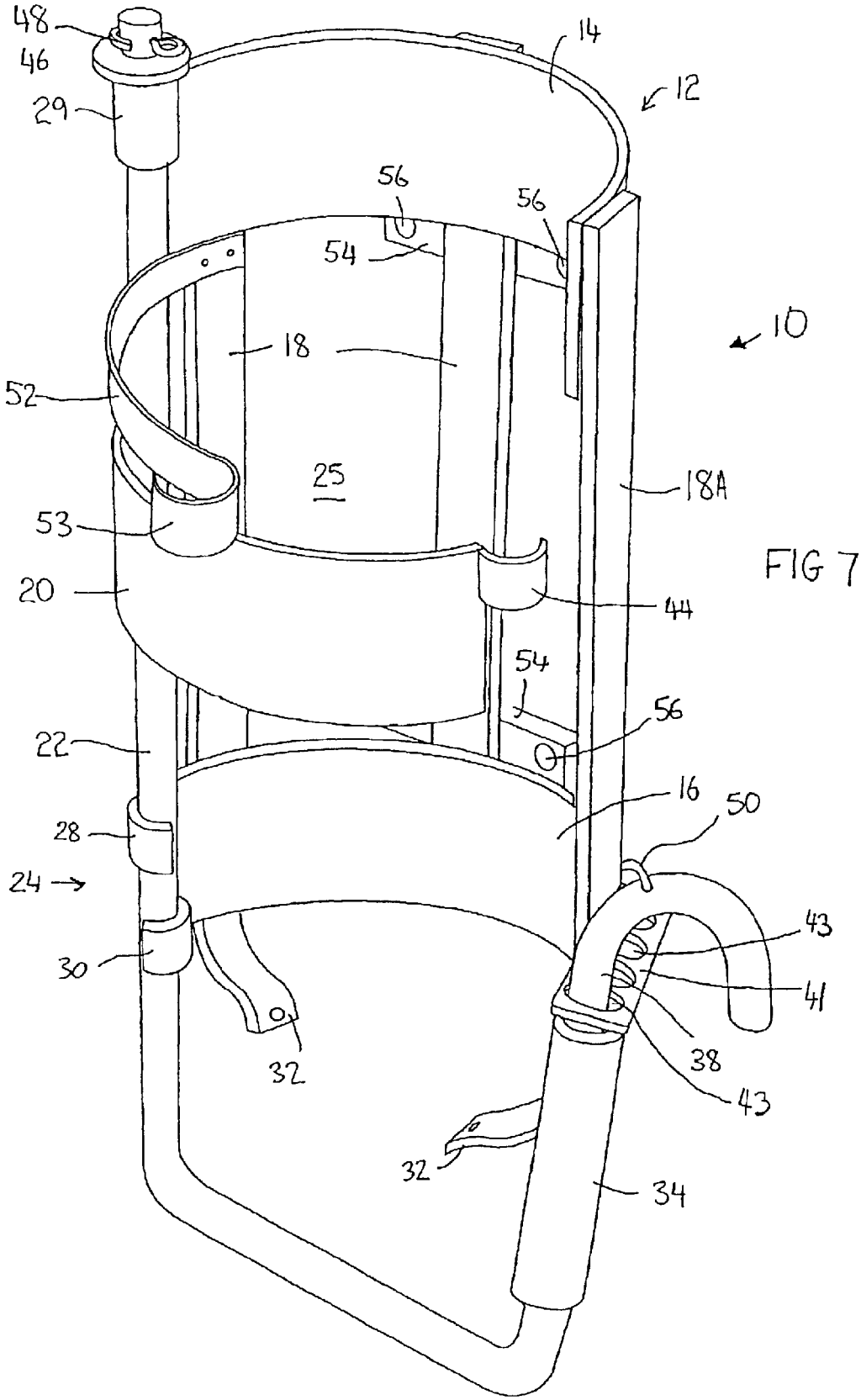
FIG. 7 is a perspective view of a third embodiment of the holder.

In FIG. 7, the locking of the handle is accomplished by a receiving member 41 that is provided with a plurality of holes 43. The locking pin 38 may pass through one of the holes 43 so as to engage the sleeve 34 of the handle. In this way, the positioning of the handle and thus the tension applied may be varied. This also accommodates varying sized fire extinguishers being held within the one sized holder.

To further accommodate the variety of sizes of extinguisher, the length of the curved front plate of the gate member 20 is shorter than shown in FIGS. 1 and 2. Thus, when the gate is closed it will not meet with connecting member 18A. In addition, the front plate is provided with a further curved clamp 44 for clamping a hose of the extinguisher between the clamp 44 and the actual extinguisher when the gate is closed. This allows the hose to be free at the same time as the extinguisher is released.

The holder 10 of FIG. 7 is only provided with two lugs 32 at the sides of the holder. The central lug is not present as it can sometimes provide an obstruction to the extinguisher outlet.

The locking pin 38 is provided with a wire trace 50 that connects the locking pin to the holder so that if it is dropped the locking pin will only fall the length of the trace and thus will not be lost. The receiving member may extend downwardly from the rear end thereof to form a hand grip. The hand grip may be used with the sleeve 34 to be squeezed together to relieve the tension applied to the locking pin 38.

The top of the full lap collar 29 connects to the hinge pin slightly differently from that shown in FIGS. 1 and 2. In this instance a washer 46 is placed over the hinge pin and a split pin is passed through a hole at the end of the hinge pin and separated so as to hold the washer in place thereby retaining the hinge pin within the collar 29.

The central connecting member 18 includes a pair of mounting plates 54 attached rearwardly, each of which are provided with holes 56 for mounting the holder in place.

The holder 10 of FIG. 7 includes a spring clip 52. This may also include a paddled sleeve to protect the extinguisher. This may be used to hold the extinguisher within the seat member 12 when the gate member 20 is opened. Being a spring, the extinguisher may be easily removed.

Figure 8:
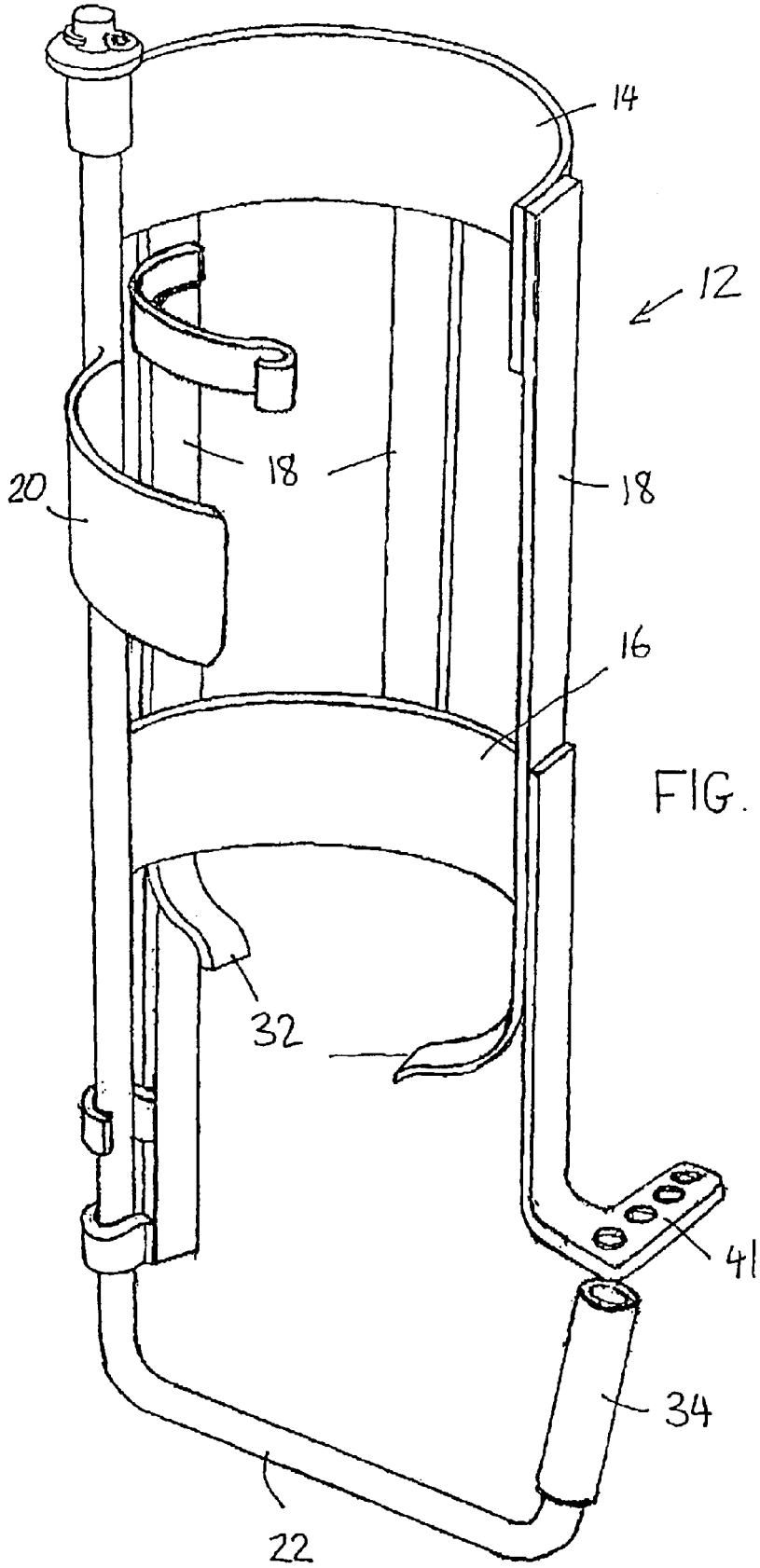
FIG. 8 is an upper perspective view of yet another embodiment of the holder of the present invention.

In FIG. 8 an alternative holder is shown, with like numerals depicting like parts from previously described embodiments. This holder is adapted to hold a compressed air canister or tank and thus the bottom of the handle and receiving member 41 are extended further below the lugs 32. In particular some compressed air cylinders have a strap-on backpack that will hang down from the cylinder and thus the spacing of the handle and receiving member 41 from the lugs allows this to hang down and not get caught.

Figure 9A:
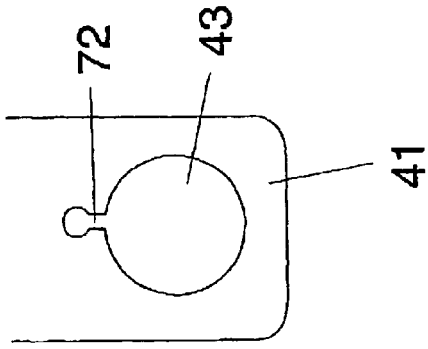
FIG. 9*a* is a top view of a portion of the receiving plate of FIG. 9.
Figure 9:
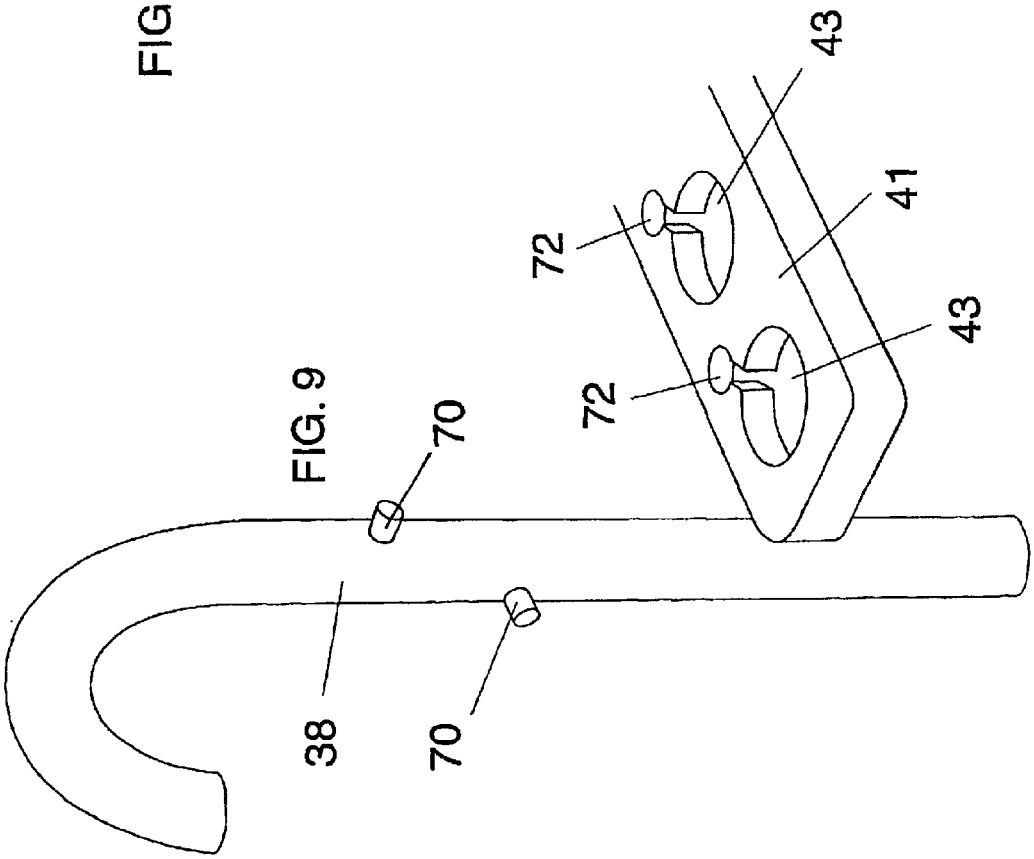
FIG. 9 is an upper perspective view of a locking pin and a receiving plate.

FIG. 9 shows a locking pin 38 and receiving member 41. In this case, the receiving pin 38 includes radial projections 70. The radial projections 70 pass through slots 72 that extend from holes 43 in the receiving member. The projections thus lock the locking pin in place unless the locking pin is rotated so that the projection 70 coincides with this slot 72 so that the pin may be withdrawn from the hole 43. This feature provides an additional safety measure in that the locking pin 38 cannot easily be removed and it effectively provides a childproof lock. In the particular version shown in FIG. 9, two sets of projections are shown 70 so that the locking pin must be drawn upwardly rotated so as to coincide the higher of the projections 70 with the slot 72 is lifted through and then must be rotated again so that the lower projection 70 coincides with the slot 72 and the remainder of the locking pin may be withdrawn from the hole. Other arrangements can be made to provide the childproof lock. FIG. 9*a* shows the hole 43 in the receiving member and its slot 72 more clearly.

It will also be appreciated that in some instances the pin receiving sleeve 34 will be of a different configuration than shown in FIGS. 1, 2, 7 and 8, such as that shown in FIG. 4 or some other variations that avoid clogging of the sleeve with fine particles.

The method and operation of the present invention will now be described with reference to the drawings.

The fire extinguisher is inserted within the semi-cylindrical seat member 12 either in an upright or inverted orientation so as to rest on the lugs 32 which preferably are padded, when the gate member 20 is in the open position. The handle is then rotated so as to close the gate member 20 which swings around and makes contact with the extinguisher. The handle is turned further so that a torsional force is created in the torsion bar and applied to the gate member 20. This causes the gate member 20 to apply a compressive force to the extinguisher via the padding. The extinguisher will not compress, although the sponge 40 and 42 will. A firm grip is therefore applied to the extinguisher. When the handle is turned sufficiently, the locking pin 38 is then inserted into the sleeve or plate 36 or receiving member 41 thereby locking the handle in position.

To release the fire extinguisher the locking pin 38 is simply removed. The handle will open slightly due to the resilience of the sponge padding 40 and 42 and the release of the torsional force. It may then be rotated to fully open the gate member 20 and the extinguisher removed.

The skilled addressee will appreciate that the present invention has advantages over the prior art as it contains few moving parts that are of a sturdy construction and therefore resist being shaken apart by vibration and it will allow for a fire extinguisher to be periodically inverted to discourage compaction of powder in the extinguisher, if applicable.

Modifications and variations can be made to the present invention without departing from the basic inventive concept. Such modifications may include varying the shape of the seat and gate members or altering the form of locking of the handle or the hinge arrangement. A spring or a clip may be used to retain the locking pin 38 in place in case it inadvertently bounces free from the sleeve 34. As a further alternative to the locking pin arrangement a ratchet arrangement may be used to keep the handle closed with a button or leaver provided to release the ratchet arrangement. Such modifications are deemed to be within the scope of the present invention, the nature of which is to be determined from the foregoing description.

What is claimed is:

1. A holder for holding an article, said holder including:

a seat member shaped to receive the article;

a gate member hingedly coupled to the seat member by an elongate member, the gate member shaped to co-operate with the seat member in a closed position so as to grasp the article, wherein the elongate member comprises a torsion bar connected with the gate member; and a rotatable handle connected with the torsion bar through which a torsional force may be transferred so as to move the gate member relative to the seat member between an open position and the closed position as the handle is rotated, the handle having a locking means for locking the handle in place when the handle is rotated to a locked position;

wherein the handle is arranged to apply a torsional force through the torsion bar to the gate member when the handle is in the locked position so as to compressively hold the article between the gate member and the seat member.

2. A holder according to claim 1, wherein the handle must be rotated (over rotated) further than a position where the gate member is closed to be positioned in the locked position, the over rotation causing a compressive gripping force to be applied by the gate member to the article such that the gate continues to grasp the article while the handle is in the lock position.

3. A holder according to claim 1, wherein the torsion bar comprises a rotatable hinge pin wherein the hinge pin is coupled to the gate member and rotates relative to the seat member.

4. A holder according to claim 1, wherein when the gate member is in the locked position, the co-operatively shaped seat and gate members together when not holding the article define a void which is slightly smaller in size than the article so that the members apply a compressive gripping force to the article as it is grasped.

5. A holder according to claim 1, wherein the gate member is provided with a resiliently compressible lining.

6. A holder according to claim 1, wherein the seat member is provided with a resiliently compressible lining.

7. A holder according to claim 1, wherein the seat member is provided with a projection for preventing the article from moving through a gap between the seat and gate members in a first direction.

8. A holder according to claim 7, wherein the article rests on the projection.

9. A holder according to claim 1, wherein the gate member is resiliently compressible such that when the gate member is in the closed position and the article is held by the gate member and the seat member the compressibility allows for variations in the size of the article.

10. A holder according to claim 1, wherein the seat member is resiliently compressible such that when the gate member is in the closed position and the article is held by the gate member and the seat member the compressibility allows for variations in the size of the article.

11. A holder according to claim 3, wherein the gate member is arranged to extend from pin of the hinge without meeting the seat member when in the closed position as it grasps the article in use.

12. A holder according to claim 1, wherein the locking means is spaced from the gate member.

13. A holder for holding an article, said holder including:

a seat member shaped to receive the article;

a gate member hingedly coupled to the seat member, the gate member shaped to co-operate with the seat member in a closed position so as to grasp the article;

an elongate torsion bar connected with the gate member such that twisting of the torsion bar causes opening or closing of the gate member; and a handle connected with the torsion bar so as to twist the torsion bar thereby moving the gate member between an open position and the closed position as the handle is rotated, the handle having a locking means for locking the handle when the handle is rotated to a lock position;

wherein the torsion bar forms a part of a hinged coupling between the gate member and the seat member.

* * * * *